US009498018B2

(12) United States Patent
Binder

(10) Patent No.: US 9,498,018 B2
(45) Date of Patent: Nov. 22, 2016

(54) HIGH HEEL SHOE

(71) Applicant: Arye Binder, Brooklyn, NY (US)

(72) Inventor: Arye Binder, Brooklyn, NY (US)

( * ) Notice: Subject to any disclaimer, the term of this patent is extended or adjusted under 35 U.S.C. 154(b) by 294 days.

(21) Appl. No.: 14/041,383

(22) Filed: Sep. 30, 2013

(65) Prior Publication Data

US 2015/0216263 A1 Aug. 6, 2015

(51) Int. Cl.

*A43B 13/18* (2006.01)
*A43B 7/14* (2006.01)
*A43B 21/00* (2006.01)

(52) U.S. Cl.

CPC ..... *A43B 7/1425* (2013.01); *A43B 7/1435* (2013.01); *A43B 7/1445* (2013.01); *A43B 13/183* (2013.01); *A43B 21/00* (2013.01); *A43B 13/18* (2013.01)

(58) Field of Classification Search

CPC ..... A43B 21/30; A43B 21/32; A43B 21/26; A43B 13/18; A43B 13/181; A43B 13/182; A43B 13/183; A43B 13/185; A43B 13/186
USPC ..... 36/28, 27, 37, 38, 102
See application file for complete search history.

(56) References Cited

U.S. PATENT DOCUMENTS 413,693 A * 10/1889 Walker ..... A43B 13/182 182/230
819,449 A 5/1906 Otterstedt
1,088,328 A * 2/1914 Cucinotta ..... A43B 13/182 36/28
2,437,227 A * 3/1948 Manville ..... A43B 13/182 36/28
2,470,200 A * 5/1949 Wallach ..... A43B 13/08 36/1
2,710,460 A 6/1955 Stasinos
2,721,400 A * 10/1955 Samuel ..... A43B 13/182 36/169
4,296,557 A 10/1981 Pajevic
4,322,893 A 4/1982 Halvorsen
4,364,188 A 12/1982 Turner et al.
4,616,431 A 10/1986 Dassler
4,910,884 A 3/1990 Lindh et al.
5,042,175 A * 8/1991 Ronen ..... A43B 13/182 36/15
5,138,776 A * 8/1992 Levin ..... A43B 13/183 36/27
5,651,196 A * 7/1997 Hsieh ..... A43B 13/182 36/27
5,671,552 A 9/1997 Pettibone et al.
6,006,449 A 12/1999 Orlowski et al.
6,393,731 B1 5/2002 Moua et al.
7,600,330 B2 * 10/2009 Chen ..... A43B 13/182 36/27
7,793,431 B2 9/2010 Yu
2002/0133976 A1 9/2002 Crutcher

FOREIGN PATENT DOCUMENTS

EP 0449762 10/1991
KR 20100121374 11/2010
WO WO 2009/082164 7/2009
WO WO 2013/123544 8/2013

OTHER PUBLICATIONS

International Search Report and Written Opinion dated Jun. 25, 2015 in International Application No. PCT/US2015/022465.

* cited by examiner

*Primary Examiner* — Jila M Mohandesi
(74) *Attorney, Agent, or Firm* — Hartman & Citrin LLC

(57) ABSTRACT

Embodiments of an improved high heel shoe are disclosed herein. According to various embodiments, the improved high heel shoe can include an upper, a sole at least partially connected to the upper, a heel at least partially connected to the sole, and a platform including a portion of the sole. The platform can include an improved platform assembly comprising a plurality of springs located between the sole and a cover that engages a foot of the wearer.

18 Claims, 8 Drawing Sheets

HIGH HEEL SHOE

BACKGROUND

Unless otherwise indicated herein, the materials described in this section are not prior art to the claims in this application and are not admitted to be prior art by inclusion in this section.

Various types of shoes become popular and/or fashionable at various times. High heel shoes have been popular for many years. Various styles of high heel shoes exist, but one common theme among the various styles and/or types of high heel shoes is that the heels tend to be exaggerated relative to other shoes. Over the years, it has been discovered that prolonged use of high heel shoes can adversely affect the health of the wearer's feet by placing a large amount of strain on a small portion of the surface area of the wearer's feet.

In fact, many wearers of high heel shoes have known for years that wearing high heel shoes for prolonged periods of time and/or walking distances in high heel shoes can result in excruciating pain. To address this problem, many wearers of high heel shoes do not wear high heel shoes or minimize the amount of time these shoes are worn. This can create inconveniences for the wearer. For example, if a wearer has a business meeting or formal function followed by time walking or standing, the wearer may wish to change shoes and/or bring a change of shoes to the event.

Bringing a change of shoes to various functions, however, may not be practical and/or feasible for various reasons. Furthermore, wearers may not wish to carry multiple pairs of shoes to events. Because of this, some people who would wear high heel shoes may opt for a more comfortable alternative, thereby sacrificing fashion and/or style for comfort.

SUMMARY

Concepts and technologies are disclosed herein for an improved high heel shoe. In some embodiments, an improved high heel shoe can include an improved platform assembly located at a platform area of the high heel shoe. The improved platform assembly can include an attachment surface such as a sole or other surface located at or near the platform portion of the shoe. In some embodiments, the attachment surface can include a top surface of the sole or another structure or surface located on top of the sole. It should be understood that this example is illustrative and therefore should not be construed as being limiting in any way.

One or more springs or other compressive structures or devices can be attached to the attachment surface or structure. The springs can be oriented such that a wearer's foot will compress the springs when the wearer walks on the shoes. The springs can provide pressure to the wearer's foot, thereby alleviating pressure on the foot of the wearer and thereby making the improved high heel shoe more comfortable relative to standard high heel shoes.

The improved platform assembly also can include other structures. In some embodiments, the improved platform assembly includes a platform assembly spring guide for engaging and/or guiding the springs to prevent deformation and/or damage to the springs when placed under tension. In some embodiments, the platform assembly spring guide can be formed from rubber, cork, plastics, foam, and/or other materials, and can include platform assembly spring guide ports through which the springs extend and/or are compressed into when under tension. Thus, the platform assembly spring guides can provide passageways through which the springs travel, and also can provide mechanisms for maintaining the integrity of the springs.

According to one aspect of the concepts and technologies described herein, an improved high heel shoe is disclosed. The improved high heel shoe can include an upper, a sole at least partially connected to the upper, a heel at least partially connected to the sole, and a platform including a portion of the sole. The platform further can include an improved platform assembly including two or more springs located between the sole and a cover that engages a foot of the wearer. The springs can be configured to provide a pressure between the sole and the cover.

According to some embodiments, the improved high heel shoe further can include a platform assembly spring guide located at the platform. The platform assembly spring guide is configured to guide the springs and to maintain the springs in an orientation at which the springs engage the cover. The platform assembly spring guide can be formed from a foam. In some embodiments, the platform assembly spring guide can include two or more platform assembly spring guide ports formed in the platform assembly spring guide. In some embodiments, the improved high heel shoe can further include a sidewall located at the platform of the shoe. The sidewall can be configured to contain the springs and the improved platform assembly and to conceal the improved platform assembly.

According to some embodiments, the improved high heel shoe further can include a sidewall located at the platform of the shoe. The sidewall can be configured to contain the springs and the improved platform assembly and to conceal the improved platform assembly. According to some embodiments, the upper further can include a toe box. In some embodiments at least one of the two or more springs can include a metal coil. In some embodiments, at least one of the two or more springs can include a spring enclosure that mates with and nests within a spring enclosure guide. In some embodiments, at least one of the springs can include a fluid filled piston. In some embodiments, at least one of the springs can include a solid piece of compressive material selected from a group of compressive materials consisting of cork, rubber, foam, and memory foam. In some embodiments, the cover can be connected to the improved high heel shoe using a connector. The connector can be at least one of a group of connectors consisting of a screw, a rivet, an adhesive, velcro, and a nail.

According to another aspect of the concepts and technologies described herein, an improved high heel shoe is disclosed. The improved high heel shoe can include an upper, a sole at least partially connected to the upper, a heel at least partially connected to the sole, a platform including a portion of the sole, and a connection mechanism that secures a cover to the improved high heel shoe. The platform further can include an improved platform assembly including two or more springs located between the sole and the cover, which can engage a foot of the wearer. The springs can be configured to provide a pressure between the sole and the cover.

In some embodiments, the improved high heel shoe further can include a platform assembly spring guide located at the platform. The platform assembly spring guide can be configured to guide the springs and to maintain the springs in an orientation at which the springs engage the cover. In some embodiments, the platform assembly spring guide can include two or more platform assembly spring guide ports formed in the platform assembly spring guide. The two or more springs can extend through the two or more platform assembly guide ports. In some embodiments, the improved high heel shoe can further include a sidewall located at the platform of the shoe. The sidewall is configured to contain the springs and the improved platform assembly and to conceal the improved platform assembly.

According to yet another aspect of the concepts and technologies described herein, a method for forming an improved high heel shoe is disclosed. The method can include obtaining a high heel shoe including an upper, a sole at least partially connected to the upper, a heel at least partially connected to the sole, and a platform including a portion of the sole; removing a cover from at least a portion of the platform; locating, at the platform, an improved platform assembly including two or more springs; and attaching the cover to the improved high heel shoe using a connection mechanism that secures the cover to the improved high heel shoe. In some embodiments, locating the improved platform assembly can include locating the improved platform assembly between the sole and the cover. In some embodiments, the springs can be configured to provide a pressure between the sole and the cover.

In some embodiments, the method further can include locating, at the platform, a platform assembly spring guide configured to guide the springs and to maintain the springs in an orientation at which the springs engage the cover. In some embodiments, the platform assembly spring guide can include two or more platform assembly spring guide ports formed in the platform assembly spring guide, and in some embodiments, the two or more springs extend through the two or more platform assembly guide ports. In some embodiments, the platform assembly spring guide can be formed from foam, and at least one of the springs can include a metal coil.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
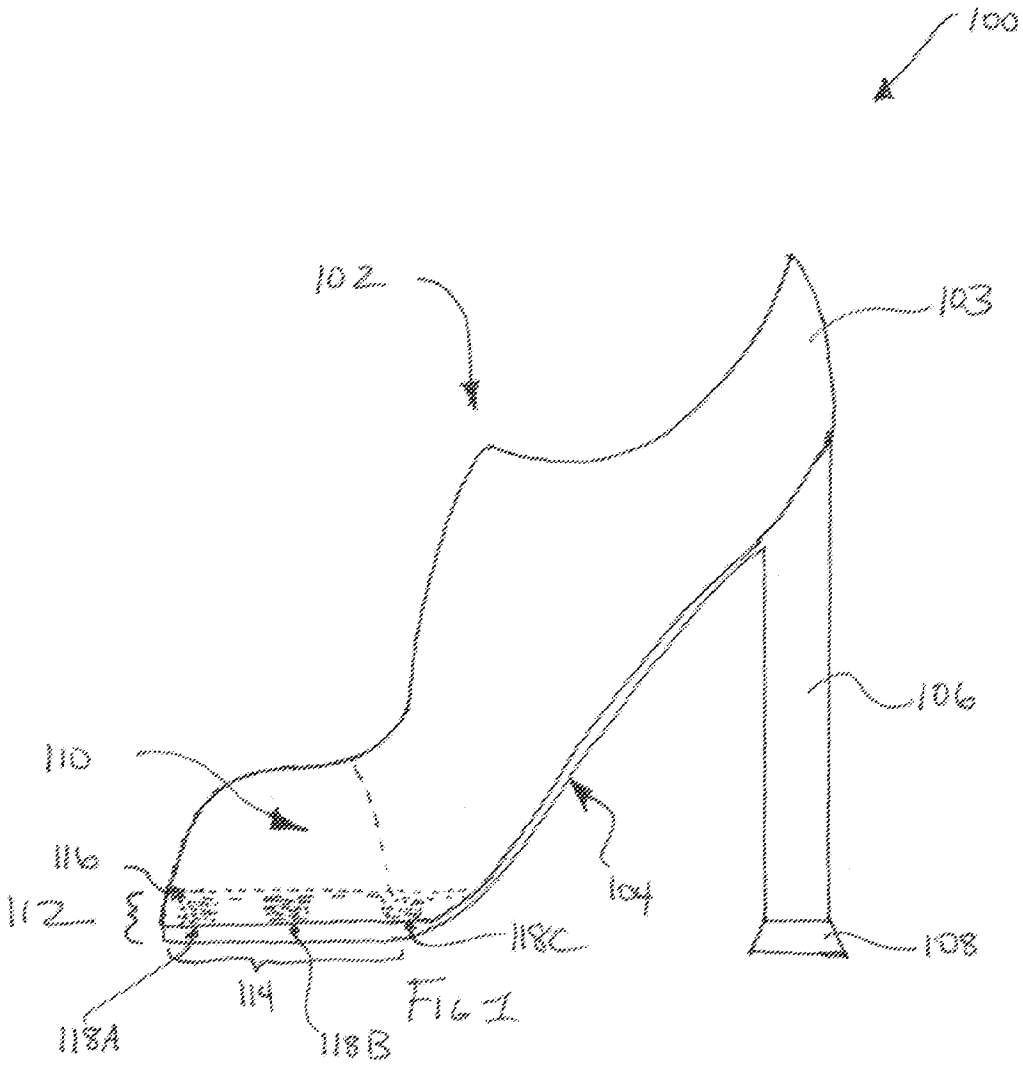
FIG. 1 is a line drawing illustrating an improved high heel shoe, according to an illustrative embodiment of the concepts and technologies described herein.

The following detailed description is directed to an improved high heel shoe. In some embodiments, an improved high heel shoe can include an improved platform assembly located at a platform area of the high heel shoe. The improved platform assembly can include an attachment surface such as a sole or other surface located at or near the platform portion of the shoe. The attachment surface can include a top surface of the sole or another structure or surface located on top of the sole, though this is not necessarily the case.

One or more springs or other compressive structures or devices can be attached to the attachment surface or structure. The springs can be oriented such that a wearer's foot compresses the springs when the wearer applies pressure onto the shoes. The springs can provide an upward (away from the ground and/or sole) pressure to the wearer's foot, thereby alleviating or counteracting downward pressure on the foot of the wearer. In some embodiments, this can make the improved high heel shoe more comfortable relative to standard high heel shoes.

The improved platform assembly also can include other structures. In some embodiments, the improved platform assembly includes a platform assembly spring guide for engaging and/or guiding the springs to prevent deformation and/or damage to the springs when placed under tension. In some embodiments, the platform assembly spring guide can be formed from rubber, cork, plastics, foam, and/or other materials, and can include platform assembly spring guide ports through which the springs extend and/or are compressed into when under tension. Thus, the platform assembly spring guides can provide passageways through which the springs travel, and also can provide mechanisms for maintaining the integrity of the springs. These and other embodiments of the concepts and technologies described herein will be illustrated and described in detail below.

In the following detailed description, references are made to the accompanying drawings that form a part hereof, and in which are shown by way of illustration specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of improved high heel shoes will be presented.

Turning to FIG. 1, an illustrative embodiment of an improved high heel shoe 100 will be described. For purposes of illustrating and describing various embodiments of the concepts and technologies described herein, the overall and/or basic structure of the improved high heel shoe 100 will be briefly described. While the improved high heel shoe 100 may include various elements also included in standard high heel shoes, this discussion is provided herein to establish terminology used herein and therefore should not be viewed as being limiting in any way. Because the concepts and technologies described herein for providing an improved high heel shoe 100 can be embodied in various implementations of high heel shoes, it should be understood that the illustrated and described illustrative embodiment is merely one example of a suitable operating environment for the concepts and technologies described herein for providing an improved high heel shoe. As such, the illustrated and described embodiments should not be construed as being limiting in any way of the concepts and technologies described herein.

In some embodiments, as shown in FIG. 1, the improved high heel shoe 100 disclosed herein can include an upper and/or vamp (hereinafter referred to as an "upper") 102. The upper 102 can be formed from various materials and/or types of materials. According to various implementations of the concepts and technologies described herein, the upper 102 can be formed from leather, suede, plastic and/or other polymers, acrylics and/or thermoplastics, glass, wood, metals and/or alloys, resins, various combinations thereof, or the like. Because shoes can be formed from almost any material and/or combination of materials, it should be understood that these examples are illustrative and therefore should not be construed as being limiting in any way.

Furthermore, it should be understood that the improved high heel shoe 100 can be formed from almost any suitable materials and is not necessarily limited to the materials and/or types of materials described above. For purposes of illustrating and describing the concepts and technologies described herein, the improved high heel shoe 100 is described herein as at least partially being formed from leather. Thus, the upper 102 in some embodiments can be formed from leather. It should be understood that this example is illustrative and therefore should not be construed as being limiting in any way.

The upper 102 can include, as generally is known, a counter 103 against which the rear of a wearer's heel pushes and/or by which the rear of a wearer's heel is engaged. The counter 103 can include a seam (not visible in FIG. 1), where two or more portions of the upper 102 meet and/or are sewn or otherwise joined together. It should be understood that this example is illustrative and therefore should not be construed as being limiting in any way.

The improved high heel shoe 100 also can include a sole 104. The sole 104 can extend across one or more bottom surfaces of the improved high heel shoe 100 as generally is known. The sole 104 can be formed from various materials, though in many premium quality shoes, the sole 104 is formed from leather. In some other shoes, the sole 104 may be formed from rubber or other polymers, plastics, foams, wood, combinations thereof, or the like. It should be understood that these examples are illustrative and therefore should not be construed as being limiting in any way.

The sole 104 can extend toward and/or can be joined to a heel 106. The heel 106 can provide height to the rear of the improved high heel shoe 100, as generally is known. Some wearers may wear the improved high heel shoe 100 to increase their physical height and/or for purposes of style and/or fashion. The heel 106 therefore can be of various heights and/or other dimensions such as width and length. The heel 106 also can include a substantially solid surface (as shown in FIG. 1) or a discontinuous surface. The heel 106 can include a heel cap 108, which may include rubber, leather, foam, and/or other types of materials for stabilizing the heel 106 and/or the improved high heel shoe 100 and/or for other purposes.

The rear portion of the improved high heel shoe 100, including substantially all of the upper 102, the counter 103, substantially all of the sole 104 other than a small portion thereof described herein below, and the heel 106 and heel cap 108 may be, but are not necessarily, substantially similar to traditional high heel shoes, if desired. As such, these elements of the improved high heel shoe 100 will not be described in additional detail herein.

The upper 102 can include and/or can be joined to a toe box 110. It can be appreciated that in some embodiments, the toe box 110 can include a portion of the upper 102, while in some other embodiments, the toe box 110 may be a separate piece of material (or pieces of material) that is or are joined to the upper 102. In other embodiments, the toe box 110 may be omitted, and as such, the wearer's toes may protrude from under the upper 102. Because high heel shoes with and/or without toe boxes 110 generally are known, these and other variations of the toe box 110 will not be described in additional detail herein.

According to various embodiments of the concepts and technologies described herein, the improved high heel shoe 100 can include an improved platform assembly 112. According to various embodiments, the improved platform assembly 112 can be located at or on top of a platform area ("platform") 114 of the improved high heel shoe 100. The improved platform assembly 112 can be used to relieve a wearer of pain and/or to reduce impact on a ball of the wearer's foot. These and other aspects of the improved platform assembly 112 are illustrated and described in additional detail below.

The improved platform assembly 112 can be covered by a liner or other cover (hereinafter referred to as a "cover") 116. The cover 116 can be an extension of a liner of the improved high heel shoe 100, if desired, or can be a separate piece or pieces of material dedicated to covering the improved platform assembly 112. According to various embodiments of the concepts and technologies described herein, the improved platform assembly 112 includes a series or network of springs 118A-C (hereinafter collectively and/or generically referred to as "springs 118"). The springs 118 can be located at various positions in the improved platform assembly 112 to provide tension between the sole 104 at the platform 114 and the cover 116. It should be understood that this example is illustrative and therefore should not be construed as being limiting in any way.

The springs 118 can be configured to generate a cushion effect at the cover 116, thereby reducing impact for a wearer of the improved high heel shoe 100 at the improved platform assembly 112. As will be explained in additional detail hereinbelow, the springs 118 can be actual springs, as shown in FIG. 1, or can be replaced with other shock absorption structures and/or materials. Various embodiments of the springs 118 will be illustrated and described in additional detail below with reference to FIGS. 6A-6D. Briefly, however, it should be noted that the springs 118 can be formed from metals or alloys such as nickel or steel, plastics or other polymers, foams and/or compressive materials such as silicone or the like. The springs 118 also can be formed from natural compressive materials such as cork, or the like.

In operation, the improved high heel shoe 100 can be formed from a standard or traditional high heel shoe by removing the cover 116 or liner at the platform 114 of the shoe. The improved platform assembly 112 can be located at the platform 114 of the shoe, and the cover 116 can be placed on top of the improved platform assembly 112. In some implementations of the concepts and technologies described herein, the upper 102 may be completely or partially removed from the sole 104 during insertion of the improved platform assembly 112, and may be reattached after the modifications are complete. Thus, by modifying a standard or traditional shoe by adding the improved platform assembly 112, an improved high heel shoe 100 can be formed. It should be understood that this example is illustrative and therefore should not be construed as being limiting in any way.

It should also be understood that after reattaching the upper 102 and/or cover 116 to the improved platform assembly 112, the improved high heel shoe 100 may not appear any different than a comparable high heel shoe, though the improved high heel shoe 100 may include an improved platform assembly 112 and/or may provide functionality associated with an improved high heel shoe 100. Thus, embodiments of the concepts and technologies described herein can provide a comfortable and healthy shoe for a wearer, in some embodiments, without compromising appearance. It should be understood that these examples are illustrative and therefore should not be construed as being limiting in any way.

Figure 2:
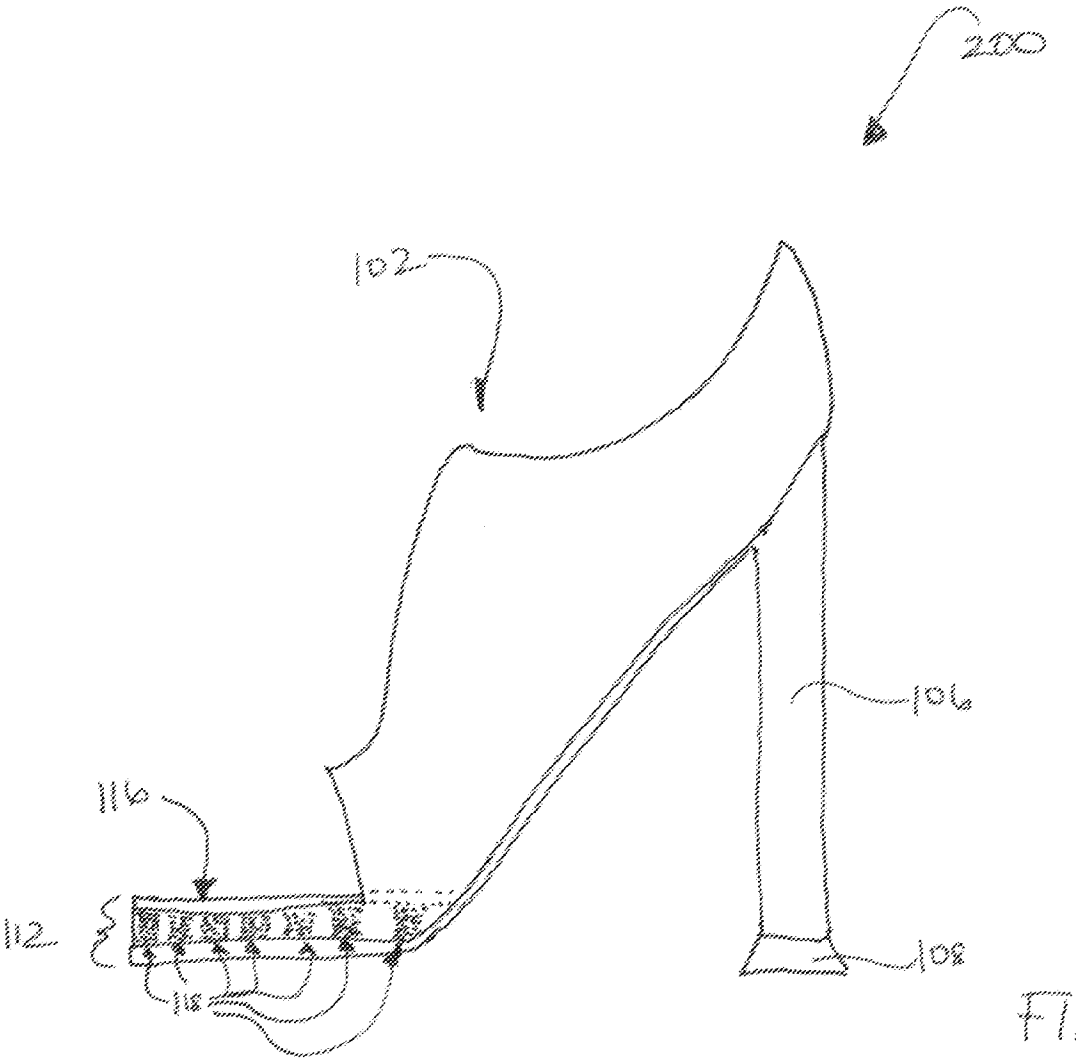
FIG. 2 is a line drawing illustrating an improved high heel shoe, according to another illustrative embodiment of the concepts and technologies described herein.

Turning now to FIG. 2, additional aspects of the concepts and technologies described herein for an improved high heel shoe will be described, according to an illustrative embodiment. In particular, FIG. 2 illustrates another embodiment of an improved high heel shoe 200. As shown in FIG. 2, and mentioned above, the toe box 110 of the improved high heel shoe 100 can be removed or omitted to provide or obtain an improved high heel shoe 200. It can be appreciated that the improved high heel shoe 200 may be substantially equivalent to the improved high heel shoe 100, though the improved high heel shoe 200 may not include a toe box 110. It should be understood that this example is illustrative and therefore should not be construed as being limiting in any way.

Additionally, as explained in further detail herein, the number of springs 118 shown in the various embodiments of the high heel shoe 100, 200 illustrated and described herein may be varied for various purposes. Thus, while the embodiments shown in FIGS. 1-2, respectively, have different numbers of springs 118, it should be understood that this is not necessarily the case, and that either or both embodiments of the improved high heel shoe 100, 200 may have the number of springs 118 shown in the FIGURES, less than the number of springs 118 shown in the FIGURES, and/or more than the number of springs 118 shown in the FIGURES. As such, the illustrated and described embodiments should be understood as being illustrative and should not be construed as being limiting in any way.

In the embodiment of the improved high heel shoe 200 shown in FIG. 2, it also can be appreciated that various embodiments of the concepts and technologies described herein can include various configurations of springs 118 and/or substitutions as described above and/or below with reference to FIGS. 6A-6D. Thus, it can be appreciated with simultaneous reference to FIGS. 1 and 2, that the improved high heel shoe 200 may include a greater number of springs 118 relative to the improved high heel shoe 100. It should be understood that this example is illustrative and therefore should not be construed as being limiting in any way.

It also should be appreciated with reference to FIGS. 1 and 2 that the springs 118 may be invisible to an observer of the improved high heel shoe 100, 200. In some embodiments, as noted above, the improved high heel shoe 100, 200 may outwardly appear no different relative to a traditional high heel shoe. In some embodiments, however, manufacturers users, or consumers may want the springs 118 to be visible to observers, and as such, part of the improved high heel shoe 100, 200 may be formed from a transparent or translucent material such as plastics, glass, or the like, and/or may be open to allow an observer to see the springs 118. It should be understood that these examples are illustrative and therefore should not be construed as being limiting in any way.

Figure 3:
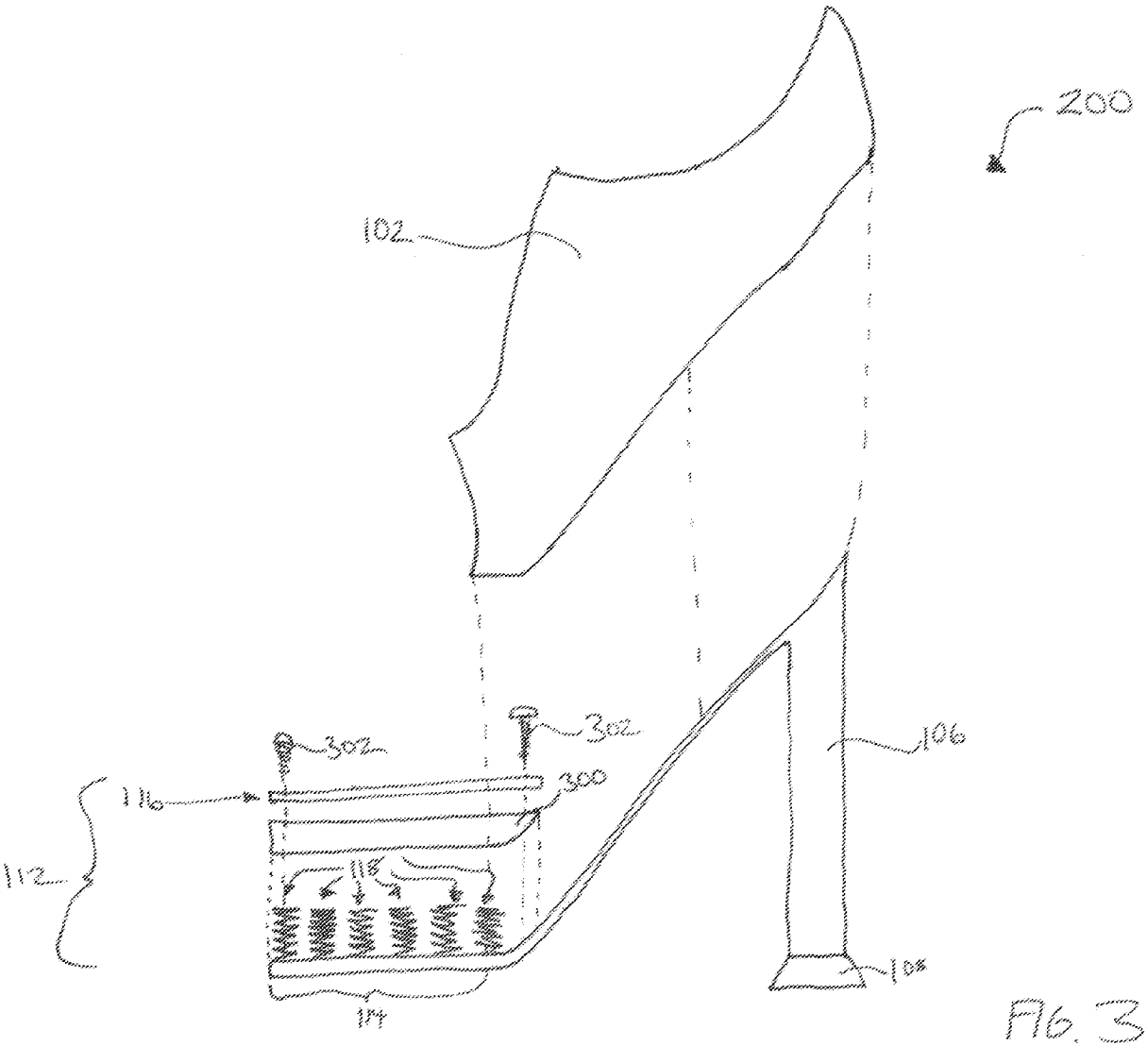
FIG. 3 is an exploded view of the improved high heel shoe shown in FIG. 2, according to one illustrative embodiment of the concepts and technologies described herein.

Turning now to FIG. 3, additional aspects of the concepts and technologies described herein for providing an improved high heel shoe 100, 200 will be illustrated and described in detail. In particular, FIG. 3 is an exploded view of the improved high heel shoe 200 shown in FIG. 2. It should be understood that this example is illustrative and therefore should not be construed as being limiting in any way.

As is visible in FIG. 3, the springs 118 can be attached to the sole 104. In some other embodiments, the springs 118 can be attached to other structures and/or surfaces between the sole 104 and the cover 116. As such, the illustrated embodiment should be understood as being illustrative of only one contemplated embodiment and should not be construed as being limiting in any way. As shown in FIG. 3, a side wall or containment surface (hereinafter referred to as a "sidewall") 300 of the improved high heel shoe 200 may be removed from the improved high heel shoe 200 to reveal the springs 118. It should be understood that the sidewall 300 can be formed from almost any material including, but not limited to, the materials used to form the cover 116, the sole 104, the counter 103, the upper 102, the heel 106, the toe box 110, the platform 114, the improved platform assembly 112, and/or other components of the improved high heel shoe 100, 200 described herein. As such, it should be understood that the sidewall 300 can be formed from plastic, wood, leather, fabric, metal, combinations thereof, or the like.

The cover 116 can be connected to the improved high heel shoe 200 and/or a desired portion thereof using one or more connection mechanisms 302. The connection mechanisms 302 can include mechanical or chemical fasteners such as, for example, screws, nails, rivets, staples, pins, clasps, adhesives, VELCRO or other fabric fastening materials, magnets and/or magnetic surfaces, combinations thereof, or the like.

During assembly of the improved high heel shoe 200, the springs 118 can be located at or near the sole 104 or another mounting surface or structure. After locating the springs 118 in location, the sidewall 300 can be located in position. The springs 118 can be attached to the sole 104 and/or other mounting surfaces using glues, pins, staples, nails, tapes, solder, thermoforming, stitching, combinations thereof, or the like. The sidewall 300 can be reinforced, in some embodiments, to help contain the springs 118 within the area of the improved platform assembly 112. Thus, for example, the sidewall 300 can be reinforced with steel, wood, plastics, metals, or the like, and/or may be formed from these or other materials with a rigidity suitable to maintain the springs 118 within the confines of the sidewall 300. It should be understood that this example is illustrative and therefore should not be construed as being limiting in any way.

After locating the sidewall 300 in position (it should be understood that the sidewall 300 can be omitted in various embodiments of the concepts and technologies described herein), the cover 116 can be placed on top of the springs 118. The cover 116 can include a piece of leather, fabric, wood, plastic, foam, or the like, or a combination of materials. In one contemplated embodiment, the cover 116 includes a rigid or semi-rigid material or substrate such as a polymer sheet or a wood sheet, which can be covered with foam and leather for comfort. In some other embodiments, the cover 116 can include a semi-rigid material such as a thick fabric or soft polymer, which can be coated with leather and/or foam to provide comfort.

Thus, the springs 118 can provide pressure that is sensed through the cover 116, or may provide pressure that moves the cover 116 (but is not felt through the cover). Regardless of whether or not a wearer can feel the springs 118 through the cover 116, the springs 118 can provide pressure that pushes against the foot of the wearer (i.e., away from the sole 104 of the shoe and toward the upper 102), thereby relieving pressure on the foot of the wearer. As such, embodiments of the improved high heel shoe 100, 200 can relieve pressure on the feet of wearers, thereby enabling wearers to maintain comfort without sacrificing appearance.

Figure 4:
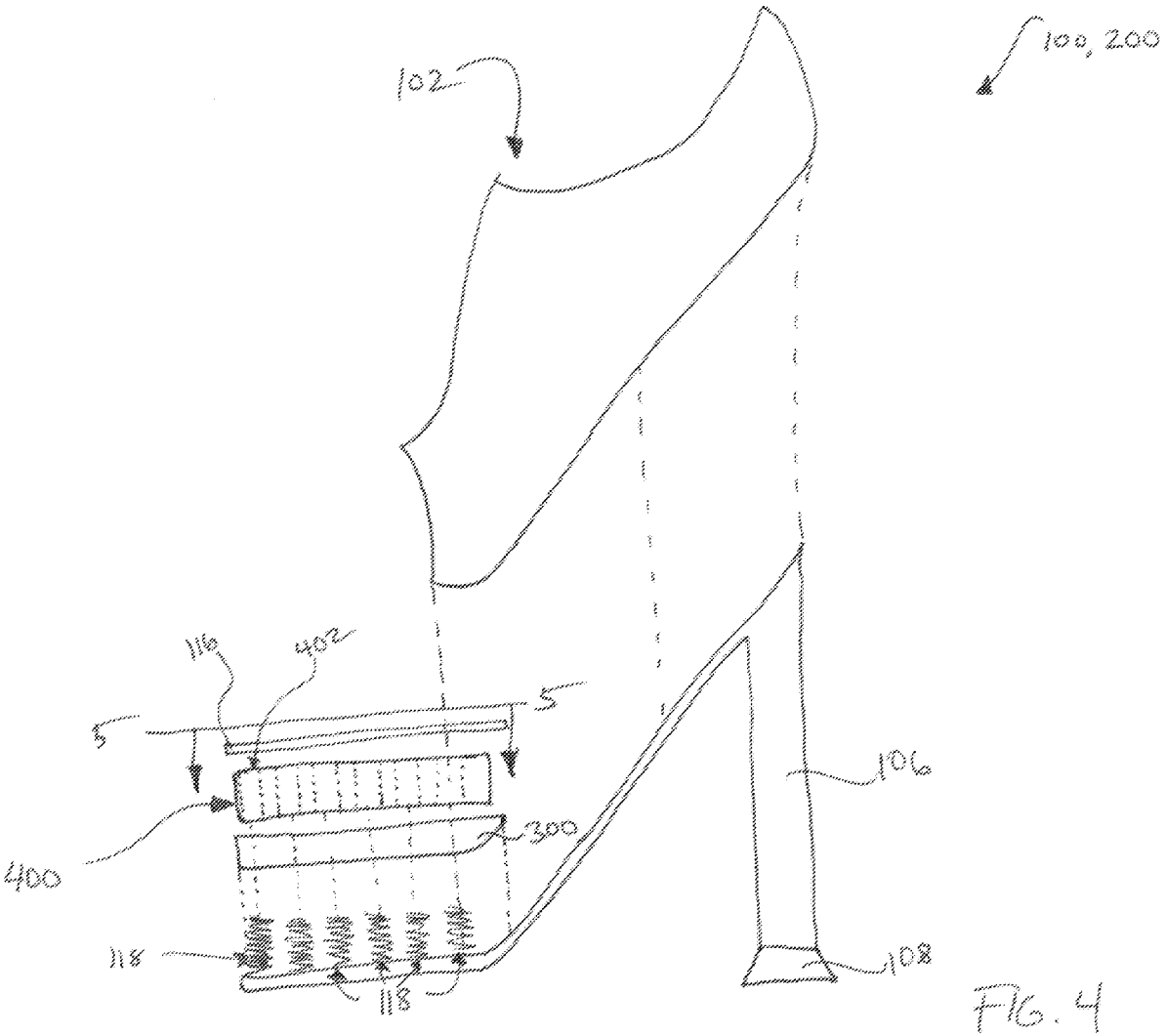
FIG. 4 is an exploded view of an improved high heel shoe, according to yet another illustrative embodiment of the concepts and technologies described herein.

Turning now to FIG. 4, additional aspects of the concepts and technologies described herein for providing an improved high heel shoe 100, 200 will be illustrated and described in detail. In particular, FIG. 4 is an exploded view of an improved high heel shoe 100, 200, according to some illustrative embodiments. It should be understood that this example is illustrative and therefore should not be construed as being limiting in any way.

In the embodiment of shown in FIG. 4, the improved high heel shoe 100, 200 can be essentially similar to the improved high heel shoe 100, 200 described above with reference to FIGS. 1-3, but also can include a platform assembly spring guide 400 for guiding the springs 118 included in the improved platform assembly 112. The platform assembly spring guide 400 will be illustrated and described in additional detail below with reference to FIG. 5, but some aspects of the platform assembly spring guide 400 may be more easily understood in the context of its operating environment as shown in FIG. 4.

In particular, the platform assembly spring guide 400 can be provided to guide the springs 118 and/or to maintain the springs 118 in a linearly aligned relationship relative to the sole 104 and the upper 102. As used herein, a "linearly aligned relationship" can mean that the springs 118 are aligned such that a force vector generated by the spring 118 extends perpendicularly relative to a bottom surface of the wearer's foot when placed in the improved high heel shoe 100, 200.

Thus, the linearly aligned relationship can mean aligning each of the springs 118 along an axis that passes through the center of an opening at the bottom of a spring 118 and extends toward and through a center of an opening at the top of the spring 118, wherein the bottom of the spring 118 may be defined as the portion of the spring 118 at or proximate to the sole 104. It should be understood that this example is illustrative and therefore should not be construed as being limiting in any way. It therefore can be appreciated that in some embodiments, the sidewall 300 may be omitted if the platform assembly spring guide 400 is included. In some other embodiments, the sidewall 300 can be used to maintain the platform assembly spring guide 400 in position at the platform 114 of the improved high heel shoe 100, 200. It should be understood that these examples are illustrative and therefore should not be construed as being limiting in any way.

As can be seen in FIG. 4, and as will be described in additional detail below with reference to FIG. 5, the platform assembly spring guide 400 can include a number of platform assembly spring guide ports 402. The platform assembly spring guide ports 402 can be shaped such that the inner surface of the platform assembly spring guide ports 402 engage or contain the springs 118. Thus, if the functionality associated with the springs 118 is provided by cylindrically shaped springs 118, for example, the platform assembly spring guide ports 402 may be cylindrically shaped as well, though this is not necessarily the case. As noted above, the springs 118 may be shaped in almost any manner including, but not limited to, cylindrical springs 118. Thus, the springs 118 may have any shape and need not be round or cylindrical, if desired.

Thus, the platform assembly spring guide 400 and the platform assembly spring guide ports 402 may be used to lengthen the useful life of the improved platform assembly 112 by maintaining the springs 118 in a proper orientation and/or by preventing deformation of the springs 118 during use, though this is not necessarily the case. Furthermore, the platform assembly spring guide 400 can be formed from a soft or compressive material such as memory foam, foam, cork, plastic, rubber or other polymers, or the like, and therefore can be used to not only provide the functionality described hereinabove with respect to the platform assembly spring guide ports 402, but also to provide additional support and/or cushion to the improved platform assembly 112 and/or the improved high heel shoe 100, 200. It should be understood that these examples are illustrative and therefore should not be construed as being limiting in any way.

Figure 5:
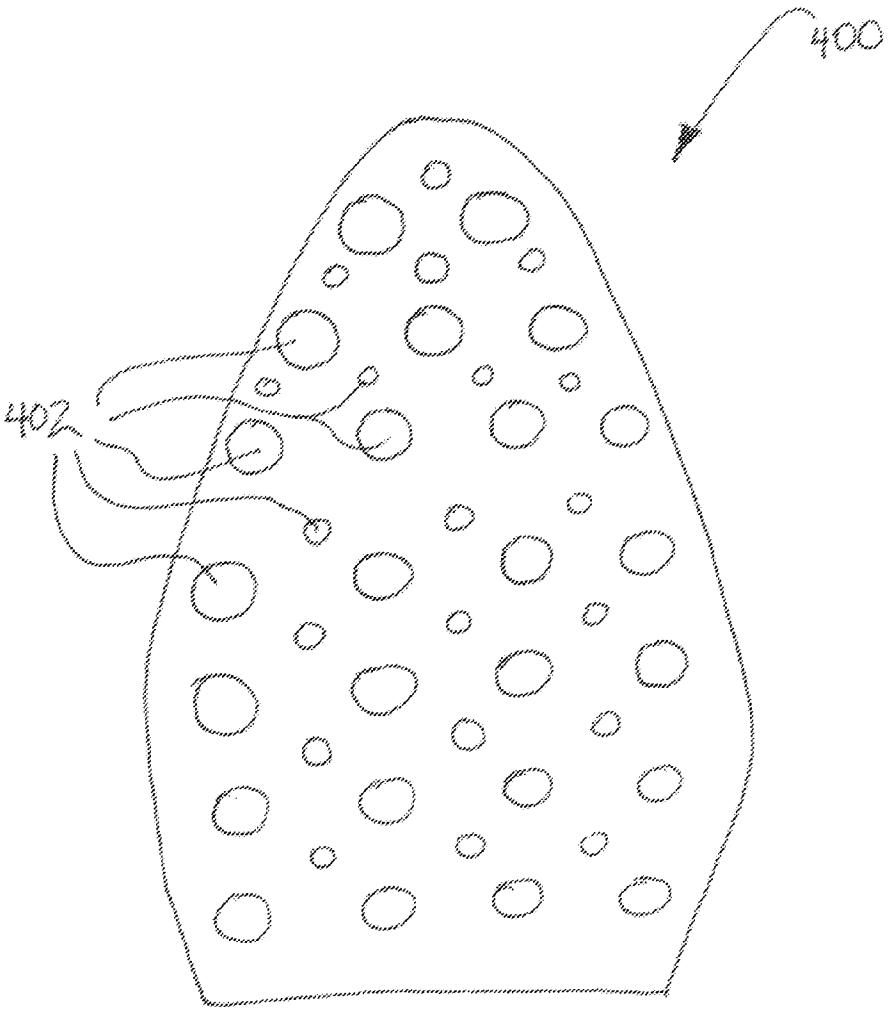
FIG. 5 is a line drawing illustrating a top elevation view of a spring guide for an improved high heel shoe, according to an illustrative embodiment of the concepts and technologies described herein.

Turning now to FIG. 5, a top elevation view of the platform assembly spring guide 400 is shown. It can be appreciated that the view depicted in FIG. 5 can be a view of the platform assembly spring guide 400 from the line 5-5 illustrated in FIG. 4. It should be understood that this example is illustrative and therefore should not be construed as being limiting in any way.

As can be seen in FIG. 5, the platform assembly spring guide 400 can have numerous platform assembly spring guide ports 402. Though not visible in FIGS. 1-4, it can be appreciated with reference to FIG. 5 that the platform assembly spring guide ports 402 are not necessarily all of uniform size and/or shape. Similarly, though not visible in FIGS. 1-4, the springs 118 included in any particular embodiment of the improved high heel shoe 100, 200 are not necessarily of equal size, shape, height, thickness, tension, or the like.

Thus, it can be appreciated that the springs 118 can be varied for various purposes such as, for example, to provide more or comparatively less pressure at various positions within the improved high heel shoe 100, 200. Again, it must be understood that the number of platform assembly spring guide ports 402 and/or the varied size and/or configurations and locations of the platform assembly spring guide ports 402 may be varied for various purposes and/or considerations such as, for example, the weight of the wearer; the size of the wearer's foot; a foot, leg, back, hip, and/or other condition associated with the wearer; the size and/or strength of the springs 118 used; the materials from which the improved high heel shoe 100, 200 is formed; combinations thereof; or the like. As such, it should be understood that the illustrated examples are illustrative and therefore should not be construed as being limiting in any way.

Turning now to FIGS. 6A-6D, additional aspects of the concepts and technologies described herein for an improved high heel shoe 100, 200 will be described, according to some illustrative embodiments. In particular, FIGS. 6A-6D illustrate various embodiments of the springs 118 described hereinabove. Because additional and/or alternative embodiments of the springs 118 are possible and are contemplated, it should be understood that these examples are illustrative and therefore should not be construed as being limiting in any way.

Figure 6A:
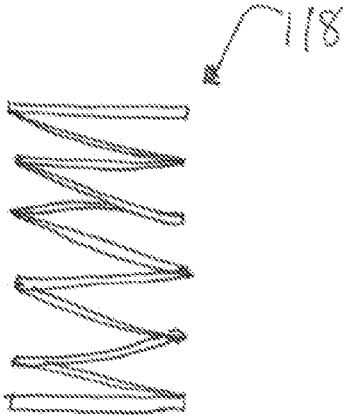
FIGS. 6A-6D are line drawings illustrating various embodiments of the springs or compression devices for use in an improved high heel shoe, according to various illustrative embodiments of the concepts and technologies described herein.

As shown in FIG. 6A, the functionality of one or more of the springs 118 can be provided by a metal or plastic spring having a helix shape. Because helix-shaped springs generally are known and/or understood, the embodiment shown in FIG. 6A will not be further described herein. It should be noted, however, that the thickness of the coil, the strength of the materials used, the length of the coil, the diameter of the coil, and/or other material properties of the coil (e.g., hardness, elasticity, tensile strength, combinations thereof, or the like) can be varied to provide more or less force via the spring 118. Because the alteration of metal and/or plastic coils to provide springs generally is known, these and other variations will not be further discussed herein.

Figure 6B:
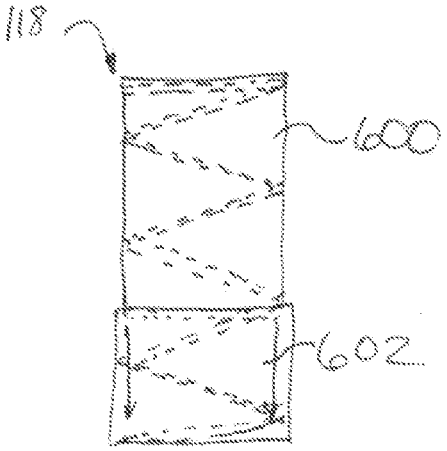

Turning now to FIG. 6B, additional aspects of the springs 118 are illustrated and described, according to another illustrative embodiment. In particular, the spring 118 shown in FIG. 6B can be similar or different from the spring 118 shown in FIG. 6A, but may be located within a structure to align and/or maintain the spring 118 as discussed above with reference to the platform assembly spring guide 400 in FIG. 4. As shown in FIG. 6B, the spring or another compressive structure can be located within a spring enclosure 600.

The spring enclosure 600 can be sized and dimensioned to maintain the spring 118 in a proper orientation and/or to prevent deformation of the spring 118 under pressure and/or in use, though this is not necessarily the case. As shown in FIG. 6B, the spring enclosure 600 can be inserted into and/or can mate with a spring enclosure guide 602 to allow compression of the spring 118 by nesting the spring enclosure 600 into the spring enclosure guide 602. Thus, the spring enclosure 600 and/or the spring enclosure guide 602 can provide functionality that is similar to the platform assembly spring guide 400 described n FIG. 4, though without requiring the addition of the platform assembly spring guide 400. Furthermore, it can be appreciated that the spring enclosure 600 and/or the spring enclosure guide 602 (or portions thereof) can be sized and/or configured to vary the engagement surface thereof to modify an amount of surface of the spring enclosure and/or spring enclosure guide 602 that engages the cover 116 or other surface. It should be understood that these examples are illustrative and therefore should not be construed as being limiting in any way.

Figure 6C:
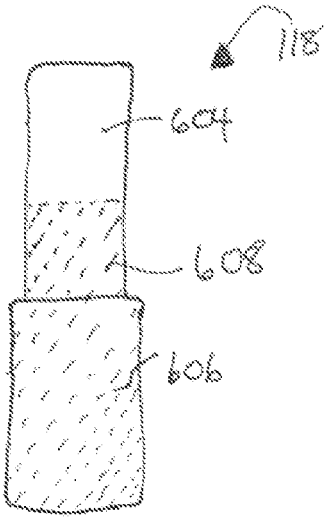

Turning now to FIG. 6C, additional aspects of the springs 118 are illustrated and described, according to another illustrative embodiment. In particular, the spring 118 shown in FIG. 6C can include a fluid filled piston 604 or other compressive device. In some embodiments, the fluid filled piston 604 can include two or more elements 606, 608, and can be filled with a fluid. The fluid can include air, gases, liquids, oils, or the like. Thus, it can be appreciated that the springs 118 can include numerous structures such as pistons, or the like, instead of, or in addition to, springs such as the spring 118 shown in FIG. 6A. It should be understood that this example is illustrative and therefore should not be construed as being limiting in any way.

Figure 6D:
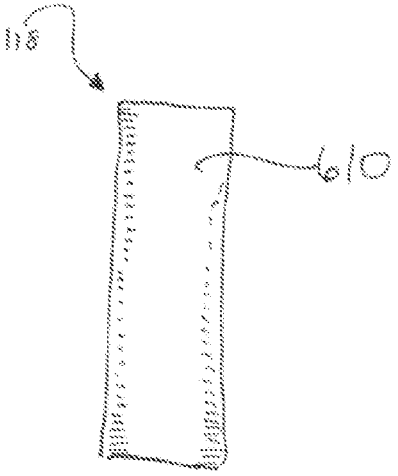
Figure 7:
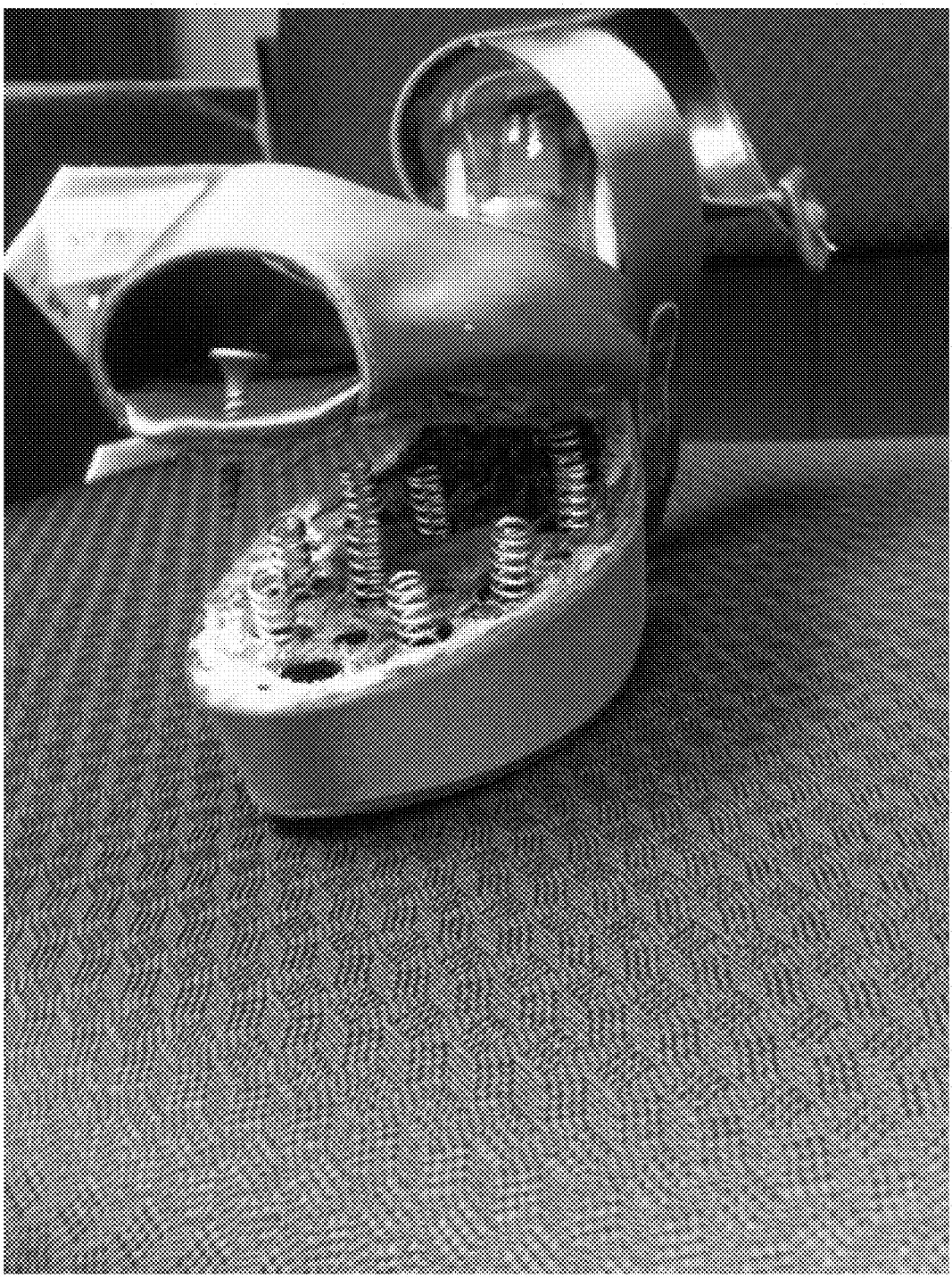
FIG. 7 is a perspective view of the improved high heel shoe, according to one embodiment of the concepts and technologies described herein.

Turning now to FIG. 6D, additional aspects of the springs 118 are illustrated and described, according to another illustrative embodiment. In particular, the spring 118 shown in FIG. 6D can include a solid piece of material such as a column 610 of foam, cork, plastic, rubber, fabric, other materials, or the like. It should be understood that the spring 118 shown in FIG. 6D may have almost any shape and need not be cylindrical. It should be understood that this example is illustrative and therefore should not be construed as being limiting in any way. A perspective view of the high heel shoe 100, 200 is shown in FIG. 7.

Figure 8:
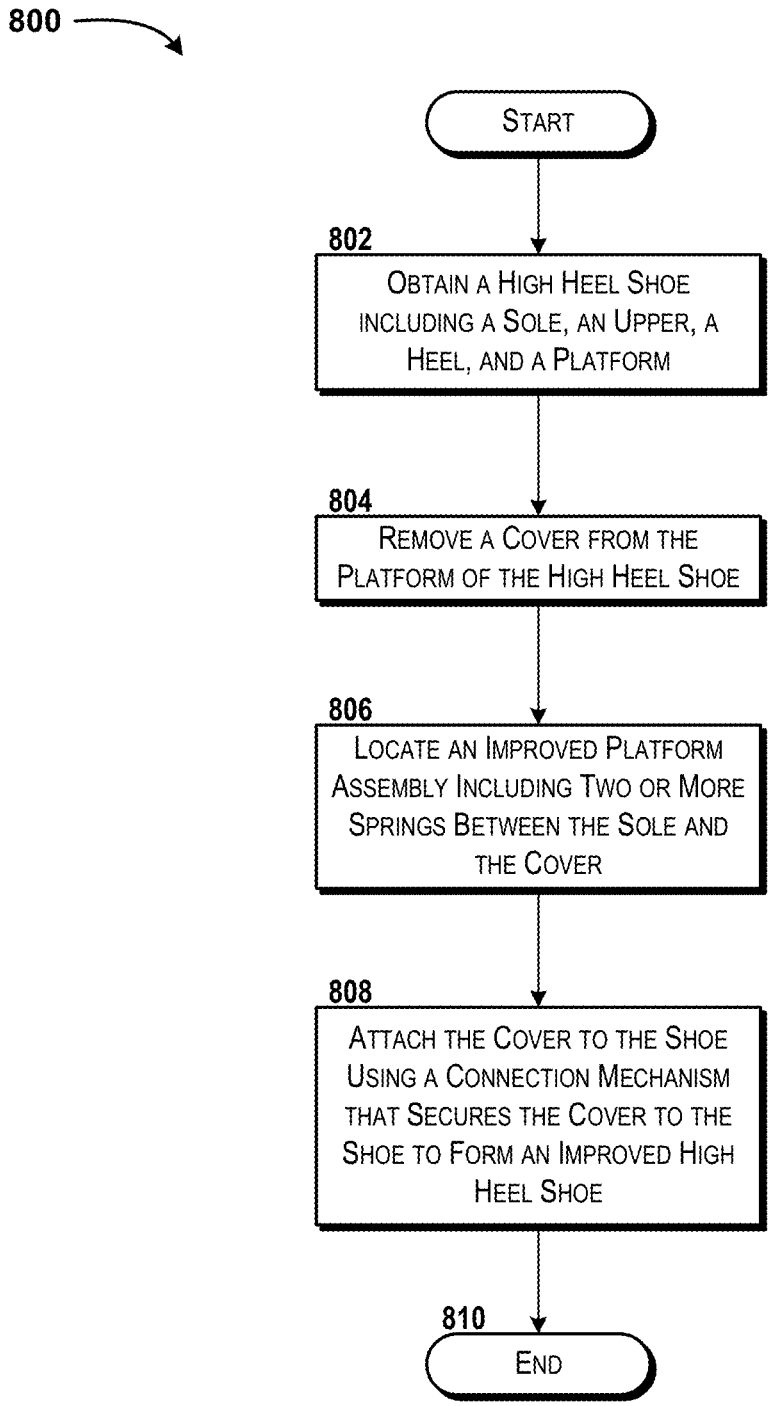
FIG. 8 is a flow diagram schematically illustrating a method for forming an improved high heel shoe, according to one embodiment of the concepts and technologies described herein.

Turning now to FIG. 8, aspects of a method 800 for forming an improved high heel shoe 100, 200 will be described in detail. It should be understood that the operations of the method 800 disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the appended claims.

It also should be understood that the illustrated method 800 can be ended at any time and need not be performed in its entirety. Additionally, it should be understood that the operations of the method 800 described herein can be performed by an improved high heel shoe forming machine, which can include a special purpose computing system that includes a memory and a processor. The processor can execute computer instructions stored in the memory to cause the improved high heel forming machine to execute the operations described herein. The memory can include any type of data storage mechanism that stores data in a non-transitory fashion, i.e., for a period of time that exceeds one microsecond. As such, the memory described herein excludes propagating waves, signals per se, and/or other non-transitory storage media.

In some other embodiments, a shoemaker can execute the operations described herein to transform matter such as a high heel shoe to form an improved high heel shoe 100, 200. As such, the operations described herein can transform a high heel shoe into an improved high heel shoe as described herein. Because the improved high heel shoe 100, 200 may be formed in other ways, it should be understood that these examples are illustrative and therefore should not be construed as being limiting in any way.

The method 800 begins at operation 802. In operation 802, a high heel shoe is obtained. The high heel shoe can be provided by a customer, provided by a supplier, obtained from a high heel shoe manufacturing line that is proximate to the improved high heel shoe forming machine and/or the operator forming the improved high heel shoe 100, 200, and/or otherwise obtained. According to various embodiments, the high heel shoe obtained in operation 802 includes a sole 104, an upper 102, a heel 106, and a platform 114 as described hereinabove. It should be understood, however, that in some embodiments the high heel shoe obtained in operation 802 may not include some or all of these components, and that these components may be added to the high heel shoe via execution of the operations described herein with respect to the method 800. As such, the illustrated embodiment of the method 800 should be understood as being illustrative of one contemplated embodiment and should not be construed as being limiting in any way.

From operation 802, the method 800 proceeds to operation 804. In operation 804, a cover 116 can be removed from a platform 114 of the high heel shoe. As noted above, the cover 116 can be at least partially attached to the platform 114, in some embodiments, and therefore can be at least partially removed in operation 804. It should be understood that the cover 116 may not be completely removed from the high heel shoe in operation 804, if desired. Rather, in some embodiments the cover 116 is at least partially attached to the platform 114 throughout execution of the operations described herein with reference to the method 800. It should be understood that these examples are illustrative and therefore should not be construed as being limiting in any way.

From operation 804, the method 800 proceeds to operation 806. In operation 806, an improved platform assembly 112 can be located between the sole 104 and the cover 116 and/or between the cover 116 and the platform 114. In some embodiments, the improved platform assembly 112 is used to replace the platform 114 and therefore operation 806 can include removing the platform 114 and locating the improved platform assembly 112 between the sole 104 and the cover 116. It should be understood that this example is illustrative and therefore should not be construed as being limiting in any way.

According to various embodiments of the improved platform assembly 112, as illustrated and described above with reference to FIGS. 1-7, the improved platform assembly 112 can include two or more springs or spring mechanisms (hereinafter collectively and/or generically referred to as "springs 118"). As explained above, the springs 118 may be the same size, shape, and configuration in some embodiments. In some other embodiments, one or more of the springs 118 may have a different size, shape, configuration, composition, and/or the like relative to other springs 118. As such, it can be appreciated that almost any number and/or type and/or combination of springs 118 may be included in the improved platform assembly 112. As such, the illustrated embodiments should not be construed as being limiting in any way.

From operation 806, the method 800 proceeds to operation 808. In operation 808, the cover 116 can be attached to the shoe (formerly a high heel shoe) to form the improved high heel shoe 100, 200. In some embodiments, the cover 116 is attached to the shoe using one or more connection mechanisms 302. As such, it can be appreciated that after operation 808 has been completed, the improved high heel shoe 100, 200 may look substantially identical to the high heel shoe obtained in operation 802, while the inner structure of the improved high heel shoe 100, 200 may include the improved platform assembly 112 instead of, or in addition to, the platform 114. In yet other embodiments, the platform 114 can be modified in operation 806 to transform the platform 114 into the improved platform assembly 112. As such, the illustrated and described embodiments should be understood as being illustrative of the concepts and technologies described herein and should not be construed as being limiting in any way.

From operation 808, the method 800 proceeds to operation 810. In operation 810, the method 800 can end. Other operations can be executed at operation 810, though these are not show in FIG. 8. For example, the improved high heel shoe 100, 200 can be packaged, palletized, or the like. Additionally, or alternatively, the improved high heel shoe 100, 200 can be polished and/or otherwise finished or enhanced as part of the improved high heel shoe forming method described herein. It should be understood that this example is illustrative and therefore should not be construed as being limiting in any way.

While the above embodiments of the improved high heel shoe 100, 200 have been described as shoes, it should be understood that the concepts and technologies described herein can be used with other types of footwear such as boots, slippers, and/or other footwear. For example, an improved high heel boot may be formed in a manner that is substantially similar to the manner in which the improved high heel shoe 100, 200 is formed, though this is not necessarily the case.

In some embodiments, however, the concepts and technologies described herein can be used to form an improved high heel shoe and not an improved high heel boot. As such, some embodiments of the concepts and technologies described herein are directed to an improved high heel shoe that is not an improved high heel boot. Similarly, some embodiments of the concepts and technologies described herein can be used to form an improved high heel boot and not an improved high heel shoe. As such, some embodiments of the concepts and technologies described herein are directed to an improved high heel boot that is not an improved high heel shoe. It should be understood that these examples are illustrative and therefore should not be construed as being limiting in any way.

Based on the foregoing, it should be appreciated that embodiments of an improved high heel shoe have been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A high heel shoe comprising:

an upper;

a sole at least partially connected to the upper, wherein the sole comprises a platform area that is located at a portion of the sole that corresponds to an area at which a ball of a foot of a wearer is located if the high heel shoe is worn;

a heel connected to a portion of the sole; and a platform assembly comprising a platform assembly spring guide and a plurality of springs, wherein the platform assembly is located at the platform area and between the sole and a cover that is configured to engage the foot of the wearer, wherein the plurality of springs are configured to provide a pressure between the sole and the cover, wherein the platform assembly is configured to reduce impact on the ball of the foot of the wearer, wherein the platform assembly spring guide comprises a plurality of platform assembly spring guide ports formed at least partially through the platform assembly spring guide, wherein the plurality of platform assembly spring guide ports are configured to guide the springs and to maintain the springs in an orientation at which the springs engage the cover, and wherein at least one of the plurality of springs comprises a spring enclosure that mates with and nests within a spring enclosure guide.

2. The high heel shoe of claim 1, wherein the platform assembly spring guide is formed from a foam.

3. The high heel shoe of claim 1, further comprising a sidewall that is configured to contain the springs and the platform assembly and to conceal the platform assembly.

4. The high heel shoe of claim 1, wherein the upper further comprises a toe box.

5. The high heel shoe of claim 1, wherein at least one of the plurality of springs comprises a metal coil.

6. The high heel shoe of claim 1, wherein at least one of the springs comprises a fluid filled piston.

7. The high heel shoe of claim 1, wherein at least one of the springs comprises a solid piece of compressive material selected from a group of compressive materials consisting of:

cork;
rubber;
foam; and
memory foam.

8. The high heel shoe of claim 1, wherein the cover is connected to the high heel shoe using a connector, and wherein the connector is at least one of a group of connectors consisting of:

a screw;
a rivet;
an adhesive;
a loop and hook connector; and
a nail.

9. The high heel shoe of claim 1, wherein the orientation comprises a linearly aligned relationship at which a force vector generated by the springs extends perpendicularly relative to a bottom surface of the foot of the wearer.

10. The high heel shoe of claim 1, wherein the platform assembly is configured to be inserted into a high heel shoe to form the high heel shoe.

11. A high heel shoe comprising:

an upper;

a sole at least partially connected to the upper, wherein the sole comprises a platform area that is located at a portion of the sole that corresponds to an area at which a ball of a foot of a wearer is located if the high heel shoe is worn;

a heel connected to a portion of the sole; a platform assembly comprising a platform assembly spring guide and a plurality of springs, wherein the platform assembly is located at the platform area and between the sole and a cover that is configured to engage the foot of the wearer, wherein the plurality of springs are configured to provide a pressure between the sole and the cover, wherein the platform assembly is configured to reduce impact on the ball of the foot of the wearer, wherein the platform assembly spring guide comprises a plurality of platform assembly spring guide ports formed at least partially through the platform assembly spring guide, and wherein the plurality of platform assembly spring guides are configured to guide the springs and to maintain the springs in an orientation at which the springs engage the cover; and a connection mechanism that secures the cover to the high heel shoe, wherein at least one of the plurality of springs comprises a spring enclosure that mates with and nests within a spring enclosure guide.

12. The high heel shoe of claim 11, further comprising a sidewall that is configured to contain the springs and the platform assembly and to conceal the platform assembly.

13. The high heel shoe of claim 11, wherein the orientation comprises a linearly aligned relationship at which a force vector generated by the springs extends perpendicularly relative to a bottom surface of the foot of the wearer.

14. The high heel shoe of claim 11, wherein the platform assembly is configured to be inserted into a high heel shoe to form the high heel shoe.

15. A high heel shoe comprising:

an upper;

a sole that is at least partially connected to the upper, wherein the sole comprises a platform area that is located at a portion of the sole that corresponds to an area at which a ball of a foot of a wearer is located if the high heel shoe is worn;

a heel that is connected to a portion of the sole;

a cover that is at least partially connected to the sole and is configured to engage a foot of a wearer during use;

a platform assembly comprising a platform assembly spring guide and a plurality of springs, wherein the platform assembly is located at the platform area and between the sole and the cover, wherein the plurality of springs are configured to provide a pressure between the sole and the cover, wherein the platform assembly is configured to reduce impact on the ball of the foot of the wearer, wherein the platform assembly spring guide comprises a plurality of platform assembly spring guide ports formed at least partially through the platform assembly spring guide, and wherein the plurality of platform assembly spring guides are configured to guide the springs and to maintain the springs in an orientation at which the springs engage the cover; and a connection mechanism that secures the cover to the high heel shoe, wherein at least one of the plurality of springs comprises a spring enclosure that mates with and nests within a spring enclosure guide.

16. The high heel shoe of claim 15, further comprising a sidewall that is configured to contain the springs and the platform assembly and to conceal the platform assembly.

17. The high heel shoe of claim 15, wherein the orientation comprises a linearly aligned relationship at which a force vector generated by the springs extends perpendicularly relative to a bottom surface of the foot of the wearer.

18. The high heel shoe of claim 15, wherein the platform assembly is configured to be inserted into a high heel shoe to form the high heel shoe.

* * * * *